US007024149B2

(12) United States Patent
Kito et al.

(10) Patent No.: US 7,024,149 B2
(45) Date of Patent: Apr. 4, 2006

(54) SURFACE TREATMENT APPARATUS AND IMAGE-FORMING APPARATUS

(75) Inventors: Eiichi Kito, Kanagawa (JP); Hiroshi Ishizuka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 158 days.

(21) Appl. No.: 10/706,981

(22) Filed: Nov. 14, 2003

(65) Prior Publication Data

US 2004/0096250 A1 May 20, 2004

(30) Foreign Application Priority Data

Nov. 18, 2002 (JP) ..... 2002-334239

(51) Int. Cl.
*G03G 15/20* (2006.01)
*B41J 2/01* (2006.01)

(52) U.S. Cl. ..... 399/341; 399/342; 347/105

(58) Field of Classification Search ..... 399/329, 399/341, 342, 390; 347/101, 105, 155, 156, 347/212; 430/97, 124; 156/209; 101/17, 101/32; 219/216, 388, 243, 244; 392/417
See application file for complete search history.

(56) References Cited

U.S. PATENT DOCUMENTS 5,153,656 A * 10/1992 Johnson et al. ..... 399/329
5,203,941 A * 4/1993 Spain et al. ..... 156/209

FOREIGN PATENT DOCUMENTS

| | | | |
|---|---|---|---|
| DE | 1629805 A | * | 1/1971 |
| JP | 05-053288 | | 3/1993 |
| JP | 06-50056 | | 7/1994 |
| JP | 2001-053943 | | 2/2001 |

* cited by examiner

*Primary Examiner*—Arthur T. Grimley
*Assistant Examiner*—Ryan Gleitz
(74) *Attorney, Agent, or Firm*—Whitham, Curtis & Christofferson, PC

(57) ABSTRACT

The present invention aims to provide a surface treatment apparatus which can modify the surface qualities of different parts of image prints obtained by various image-forming methods, and an image-forming apparatus. For this purpose, it provides a surface treatment apparatus containing sheet heating unit which heats a sheet, a sheet cooling unit which cools the sheet in contact with a contact member, and a depression-and-protrusion shape control unit which forms depression-and-protrusion shapes by differently treating different parts of the surface of the sheet by at least one of the sheet heating unit and sheet cooling unit, and an image-forming apparatus containing this surface treatment apparatus which can easily form images having different surface qualities in different parts.

30 Claims, 10 Drawing Sheets

SURFACE TREATMENT APPARATUS AND IMAGE-FORMING APPARATUS

BACKGROUND OF THE INVENTION

1. Field of the Invention

The present invention relates to a surface treatment apparatus which can modify the surface qualities of different parts of an image print obtained by various image-forming methods, and to an image-forming apparatus comprising this surface treatment apparatus which can easily form images having different surface qualities in different parts.

2. Description of the Related Art

In the past, images have been formed by various methods such as silver halide photography, heat developing, inkjet recording, thermosensitive recording and electrophotography. In the prior art, when an image formed by various methods was a glossy surface, it was difficult to write upon it and recording was not easy.

Therefore, a photographic print having a photoesensitive material layer in only part of an image-forming surface was proposed (Japanese Utility Model Application Laid-Open No. 06-50056). However, in this case, the photographic print is not easy to reproduce, so it is unsuitable for mass production.

Another technique was proposed wherein the surface qualities of the image print were modified after image recording (Japanese Patent Application Laid-Open (JP-A) No. 05-53288). However, in this case the photographic print could not be given different properties in different parts simply by uniformly modifying the whole surface of the photographic print.

In JP-A No. 2001-053943, an image-forming system was proposed wherein color information and gloss information are acquired from an image, and image recording is performed on a recording medium based on these two types of image information. Image recording is performed by converting gloss information or non-gloss information into the thermal energy of a thermosensitive head.

In JP-A No. 05-53288 and JP-A No. 2001-53943, there was no mention of surface treatment of a thermoplastic resin layer, and surface treatment was performed by applying heat and pressure to an image-forming layer. However, even if only the surface of the image-forming layer is surface-treated, the surface (interface) depression-and-protrusion shape pattern of the thermoplastic resin layer changes with time and affects the image-forming layer surface, so a desired depression-and-protrusion shape pattern could not be obtained.

Further, when a contact member was released from the sheet at high temperature, the depression and protrusion shape pattern of the contact member transferred to the thermoplastic resin layer and image-forming layer sometimes plastically deformed in an undesirable way due to other external disturbances, and a surface coating layer (transparent clear layer) was required to improve glossiness as described in JP-A No. 2001-53943, which led to increased costs.

Therefore, a surface treatment apparatus which permitted modification of the surface qualities in different parts of an image print obtained by various image-forming methods, and an image-forming apparatus comprising this surface treatment apparatus which made it easy to form images having different surface qualities in different parts, was still unknown.

Object

It is therefore an object of the present invention to provide a surface treatment apparatus which permits modification of the surface qualities in different parts of an image print obtained by various image-forming methods, and an image-forming apparatus comprising this surface treatment apparatus which makes it easy to form of images having different surface qualities in different parts.

SUMMARY OF THE INVENTION

The surface treatment apparatus of the present invention comprises a sheet heating unit which heats a sheet, a sheet cooling unit which cools the sheet while it is in contact with a contact member, and a depression-and-protrusion shape control unit which forms different depression-and-protrusion shapes in different parts of the sheet surface by at least one of the sheet heating unit and the sheet cooling unit. In this surface treatment apparatus, the sheet heating unit heats the sheet to be surface-treated. The sheet cooling unit cools the treatment surface of the sheet while it is in contact with the contact member. The sheet cooling unit cools the sheet treatment surface while it is in contact with the contact member. The sheet treatment surface is modified in different parts by at least one of the sheet heating unit and sheet cooling unit, cooled by the sheet cooling unit, and is then separated from the contact member. When this occurs, the sheet is obtained wherein the surface qualities of the treated surface are different in different parts.

The image-forming apparatus of the present invention comprises an image-forming device which forms an image on a sheet, and the surface treatment unit of the present invention which performs surface treatment on the sheet whereon an image has been formed by the image-forming device. In this surface treatment apparatus, the image-forming device forms an image on the sheet. The surface treatment unit performs surface treatment on the sheet whereon the image has been formed by the image-forming device. When this occurs, the surface qualities in at least part of the sheet on which the image is formed, are changed.

Figure 1A:
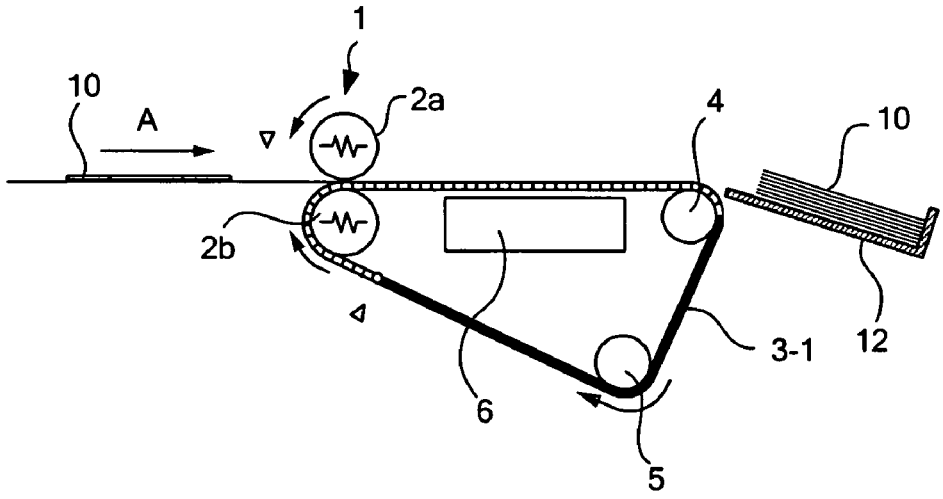
FIG. 1A is a schematic diagram showing an example of a surface treatment apparatus according to the present invention.

DESCRIPTION OF THE PREFERRED EMBODIMENTS (Surface Treatment Apparatus)

The surface treatment apparatus of the present invention comprises a sheet heating unit, a sheet cooling unit, and other units suitably selected as necessary.

Sheet Heating Unit

The sheet heating unit is not particularly limited, provided that it heats the sheet to be surface-treated, and changes the qualities of one part of the treated surface to qualities different from those of another part, either alone or together with the sheet cooling unit. It may be suitably selected according to the purpose, e.g., a unit which uniformly heats the sheet treatment surface (uniform heating unit) or a unit which performs imagewise heating (imagewise heating unit).

The uniform heating unit is generally used when the sheet treatment surface is heated while in contact with the contact member (contact state), or while not in contact with the contact member (non-contact state).

The uniform heating unit is not particularly limited and may be suitably selected according to the purpose, for example it is not particularly limited provided that it can heat the sheet to a temperature at which the thermoplastic resin layer softens and is able to deform, thus bringing about the deformation of the thermoplastic resin layer. It may for example be a unit used as a fixing apparatus in an electrophotographic apparatus known in the art, preferably comprising a pair of heat rollers or a heater (hot stamper), but among these, those having a pressure-applying function, i.e., a pair of heat and pressure rollers or a heat and pressure heater (hot pressure stamper) are more preferred.

The pair of heat rollers (heat and pressure rollers) are not particularly limited and may be suitably selected according to the purpose, e.g. they may be suitably selected from among heat roller pairs (heat and pressure roller pairs) used in electrophotographic apparatuses known in the art, but it is preferred that the nip pressure and heating temperature, etc., are adjustable.

The sheet and the contact member, superimposed on one another by the pair of heat rollers (heat and pressure rollers), pass through a nip part formed between the pair of heat rollers (heat and pressure rollers) in synchronism with the rotation of the pair of heat rollers (heat and pressure rollers) while applying heat. If pressure is applied to the nip part, the sheet and contact member, while superimposed on each other, pass through the nip part while heat and pressure are applied.

The pair of heaters (hot stampers) or pair of heat and pressure heaters (hot pressure stampers) are not particularly limited and may be suitably selected according to the purpose, but for example those bearing the design or pattern which it is finally desired to obtain on the sheet treatment surface, are preferred.

Due to the pair of heaters (hot stampers) or the pair of heat and pressure heaters (hot pressure stampers), the sheet is heated while pressure is applied to the treatment surface, the thermoplastic resin layer softens or melts, and the design or pattern formed on the surface of the pair of heaters (hot stampers) or the pair of heat and pressure heaters (hot pressure stampers) is transferred to the surface to be treated. As the design or pattern is formed with at least one of a glossy surface and a matt surface, the sheet treatment surface is also obtained as a surface comprising at least one of a glossy surface and a matt surface.

The imagewise heating unit may also be used for heating when the sheet treatment surface is heated while in contact with the contact member (contact state), but in general, it is used for heating when the sheet treatment surface is not brought into contact with the contact member (non-contact state).

In the case of the aforesaid imagewise heating unit, only a part of the sheet which is imagewise-heated by the imagewise heating unit is softened and melted, and a depression-and-protrusion shape pattern can be formed on the sheet by transferring the surface qualities of the contact member to the interface between the thermoplastic resin layer and the image-forming layer on the image-forming layer side of the sheet, and to the image-forming layer. Thus, by combining the imagewise heating unit with the surface qualities of plural contact members, the depression-and-protrusion shape pattern on the sheet can be controlled, and as a result, a desired glossiness distribution can be obtained on the sheet surface.

The imagewise heating unit is not particularly limited and may be suitably selected according to the purpose, for example it is not particularly limited provided that a desired part of the sheet is heated to a temperature at which its thermoplastic resin layer softens and is able to deform, thus bringing about deformation of the thermoplastic resin layer, and may for example comprise a thermal head.

The thermal head is not particularly limited and may be selected from among those known in the art used in thermosensitive recording printers or the like, for example a line thermal head wherein heating elements are arranged in a line, or an area thermal head wherein plural line thermal heads are arranged in parallel rows and plural heating elements are arranged horizontally and vertically, but the latter is preferred.

The unit which controls the drive of the heating elements in the thermal head so that imagewise heating can be performed is not particularly limited and may be suitably selected according to the purpose, for example a computer or the like.

The contact member may conveniently be a unit wherein its surface qualities are different in at least one part, or its thermal conduction properties are different in at least one part. Specifically, if a contact member is used wherein the surface qualities are different in at least one part, the sheet is uniformly heated by the sheet heating unit, and the surface qualities of the contact member are transferred to the sheet treatment surface in contact with the contact member when it has softened and melted due to the heat. Therefore, if the contact member has a gloss surface and a matt surface, the gloss surface and matt surface are transferred to the sheet, so that at least part of the sheet comes to have different surface qualities. Alternatively, if a contact member is used wherein the thermal conduction properties are different in at least one part, even if the sheet heating unit heats the contact member uniformly, the thermal conduction properties of at least part of the contact member are different, so the sheet is not heated uniformly. As a result, the sheet comes in contact with the contact member wherein only at least part thereof has softened and melted, so when it is separated from the contact member, the surface qualities of at least one part are different.

The contact member is not particularly limited regarding shape, structure, size and material, and may be suitably selected according to the purpose, for example a sheet cut to a desired size (texture sheet) or an endless belt. In the former case, there is the advantage that the surface state can be varied as desired for each cut sheet, while in the latter case, there is the advantage that continuous treatment is easy, and there is easy separation from the aforesaid contact member and this endless belt.

The cut sheet may for example have a completely gloss surface or a completely matt surface, but if the sheet treatment surface comprises an image part (photographic image part or the like) and non-image part (character information part, white background or the like), the locations corresponding to the image part may have a gloss surface and the locations corresponding to the non-image part may have a matt surface. In the latter case, the image part of the sheet treatment surface obtained has high gloss and excellent quality, and the non-image part has excellent writing properties.

The endless belt is not particularly limited and may be suitably selected according to the purpose, for example it is preferably designed so that it can treat sheets continuously, but more preferably takes a form wherein plural contact members each corresponding to one sheet are joined together, the sheets being brought into contact continuously one at a time. Referring to the part of the endless belt corresponding to the contact member in this aspect as a "contact member corresponding part", the contact member corresponding part may have different surface qualities, and if the sheet treatment surface has an image part (photographic image part) and a non-image part (white background), it is preferred that the locations corresponding to the image part have a gloss surface and the locations corresponding to the non-image part have a matt surface. In this case, the image part of the sheet treatment surface obtained has high gloss and excellent quality, and the non-image part has excellent writing properties.

If the aforesaid endless belt is used, it is particularly preferred that the sheet heating unit comprises this endless belt and a pair of heating rollers disposed so that the endless belt is in pressure contact from its inner side and outer side. In order to improve the parting properties of the sheet, the surface of the endless belt may be surface-treated by a silicone surface treatment agent or a fluorinated surface treatment agent.

The heating temperature produced by the sheet heating unit is not particularly limited and may be suitably selected according to the type of sheet, but it is normally of the order of 50 to 120° C., preferably of the order of 80 to 110° C. when the sheet has a thermoplastic resin layer and more preferably 95 to 105° C. when the thermoplastic resin layer is a polyethylene resin layer. Due to this, the surface (interface) of the thermoplastic resin layer is easily plastically deformed, and the depression-and-protrusion shape pattern of the depression and protrusion-forming unit can be transferred by applying pressure to the thermoplastic resin layer even under a relatively low pressure force. Further, it is more preferred to heat to a temperature equal to or higher than the softening point temperature of the image-forming layer.

The pressure produced by the sheet heating unit is preferably within a pressure range of 7 to 20 kgf/cm$^2$ in the nip part.

Sheet Cooling Unit

The sheet cooling unit is not particularly limited provided that it can cool the sheet treatment surface treated by the sheet heating unit while it is in contact with the contact member, and may be suitably selected from among cooling apparatuses known in the art according to the purpose, but from the viewpoint of being able to adjust cooling conditions, it is preferably a unit which can blow air to adjust the cooling temperature. The number of sheet cooling unit is not particularly limited, and may be suitably selected according to the purpose.

The position in which the sheet cooling unit is provided is not particularly limited and may be suitably selected according to the purpose, but it is usually downstream from the sheet heating unit in the sheet transport direction.

If the sheet heating unit comprises the pair of heat rollers and the endless belt described above, it is preferably provided between the pair of heat rollers and rotating rollers suspending the endless belt such that it is free to rotate together with the pair of heat rollers, and in the vicinity of the endless belt. In this case, the sheet is cooled by the sheet cooling unit between the pair of heat rollers and the rotating rollers.

Due to the sheet cooling unit, the thermoplastic resin in the thermoplastic resin layer of the sheet is cooled to less than the softening point temperature. Consequently, the depression-and-protrusion shape pattern transferred to (formed on) the thermoplastic resin layer cannot easily suffer further plastic deformation, and a desired depression-and-protrusion shape pattern can be reliably obtained by releasing the contact member in this state. Further, it is more preferred to cool to a temperature less than the softening point temperature of the image-forming layer, and it is still more preferred to cool to less than 80° C.

In the present invention, using one of a roller, endless belt and texture sheet as the contact member, the surface quality is preferably adjusted by modifying any of the pressure conditions, heating temperature and cooling temperature in the contact member. As a result, images having different surface qualities in sheet units, or images having different surface qualities within one sheet, can be formed. Moreover, plural rollers, belt and texture sheets having different surface roughnesses are unnecessary, and an apparatus to interchange them is also not required. It may also be noted that, as it is possible to modify any of the pressure conditions, heating temperature and cooling temperature in one sheet, a variation of surface quality may be given to one sheet so that visual effects are obtained due to gradation.

In this case, the method of modifying pressure conditions in the sheet heating unit is not particularly limited and may be suitably selected according to the purpose, for example a method which makes the spring length of nip springs at the two ends of the pressure rollers variable. The method of making the spring length variable may for example be a method due to the rotation of a cam, or a method which varies the position of a stopper by a mechanism.

The method of modifying the heating conditions in the sheet heating unit is not particularly limited and may be suitably selected according to the purpose, for example a method which makes the temperature of the heaters in the heat rollers variable. The method of making the temperature variable may be to dispose a temperature detecting apparatus on a roller surface outside the paper passage part, and control this to a desired temperature.

In practice, the surface quality of the sheet may conveniently be modified as shown in the following Table 1 and Table 2 using any of a roller, endless belt and texture sheet as the contact member.

TABLE 1

| Finish | Gloss treatment |
|---|---|
| Heating temperature parameter | Low ⟷ High |
| Sheet surface smoothness after surface treatment | x ⟷ ○ |
| Pressure parameter | Low ⟷ High |
| Sheet surface smoothness after surface treatment | x ⟷ ○ |
| Cooling temperature parameter | Low ⟷ High |
| Sheet surface smoothness after surface treatment | ○ ⟷ x |

TABLE 2

| Finish | Matt treatment |
|---|---|
| Heating temperature parameter | Low ⟷ High |
| Sheet surface unevenness after surface treatment | x ⟷ ○ |
| Pressure parameter | Low ⟷ High |
| Sheet surface unevenness after surface treatment | x ⟷ ○ |
| Cooling temperature parameter | Low ⟷ High |
| Sheet surface unevenness after surface treatment | ○ ⟷ x |

Note: In Tables 1 and 2, "○" means good, and "x" means bad.

The following relations may be determined from Table 1 and Table 2.

In the case of gloss treatment (smoothing of surface), (1) the surface is smoother, the higher is the heating temperature, (2) the surface is smoother, the higher is the pressure, (3) the surface becomes rough when the temperature of the separation part is equal to or higher than the softening point temperature of the thermoplastic resin in the thermoplastic resin layer.

In the case of matt treatment (forming depressions and protrusions), (1) the depressions and protrusions are deeper, the higher is the heating temperature, (2) the depressions and protrusions are deeper, the higher is the pressure, and (3) the depressions and protrusions are shallower, when the temperature of the separation part is equal to or higher than the softening point temperature of the thermoplastic resin in the thermoplastic resin layer.

Hence, by controlling one of the heating temperature, pressure force and cooling temperature as a surface treatment condition parameter, images can be formed with different surface qualities in sheet units, or images can be formed with different surface qualities depending on the position of the image within one sheet, even when the same contact member is used.

For example, to treat an image surface using a contact member for gloss treatment whose surface has a high smoothness, it is possible to transfer the roughness (or smoothness) profile of the surface of the contact member which has a high smoothness quite faithfully to the image surface (including the interface between the image forming layer and the thermoplastic resin layer thereof) by setting the heating temperature to 110° C. and the pressure to 20 kgf/cm$^2$. By contrast, if the heating temperature is set to 95° C. and the pressure to 7 kgf/cm$^2$, the roughness (smoothenss) profile of the surface of the contact member having a high smoothness is transferred unfaithfully to the image surface and therefore an image with less gloss can be obtained. Further, by changing the setting values of the heating pressure from 95 to 110° C. and pressure from 7 to 20 kgf/cm$^2$, it is possible to control the degree of transfer, and thus the reproduction on the image surface, of the surface of the contact member. In addition, it is also possible to control the degree of transfer and reproduction of the surface of the contact member by changing the setting value of the cooling temperature within a range of from the softening point of the thermoplastic resin layer to a temperature about 5 to 30° C. lower than the softening point.

Sheet

The sheet is not particularly limited and may be suitably selected according to the purpose, for example, an inkjet sheet, thermosensitive recording sheet, heat developing sheet (e.g., as disclosed in JP-A No. 06-130632), electrophotographic sheet, silver halide photography sheet or the like. The sheet may also be a sheet prior to image-forming or a sheet after image-forming.

The inkjet sheet may for example comprise a color material receiving-layer having a porous structure on a support, wherein a liquid ink such as an aqueous ink (using a dye or pigment as the color material) or oil-based ink, or a solid ink which is a solid at ordinary temperature and is melt-liquefied to supply the printed image, is absorbed by the color material-receiving layer to form the image.

The electrophotographic sheet may for example comprise a toner-receiving layer on a base, wherein this toner-receiving layer receives at least one of colored toners and black toner to form the image.

The thermosensitive recording sheet may for example be a thermosensitive transfer sheet having a structure comprising at least a heat-melting ink layer as an image-forming layer on a support, wherein ink from the heat-melting ink layer is heated by a thermosensitive head and is melt transferred to a thermosensitive transfer-recording image-receiving sheet, or a thermosensitive transfer sheet having a structure comprising at least an ink layer containing a heat-diffusing pigment (sublimating pigment) on a support wherein the heat-diffusing pigment from the ink layer is heated by the thermosensitive head and is transferred by sublimation to a thermosensitive transfer-recording image-receiving sheet, or a thermosensitive material used in the thermo-autochrome method (TA method) having a structure comprising at least a heat coloration layer on a support wherein an image is formed by repeatedly heating with a thermosensitive head and fixing by ultraviolet light.

The sheet comprises at least a thermoplastic resin layer on one or both surfaces of a base, comprises an image-forming layer on the thermoplastic resin layer, and if required may further comprise a surface protection layer, interlayer, undercoat layer, cushion layer, charge regulating (prevention) layer, reflecting layer, color tone adjusting layer, storage properties improving layer, anti-adhesion layer, anti-curl layer or smoothing layer.

Figure 9:
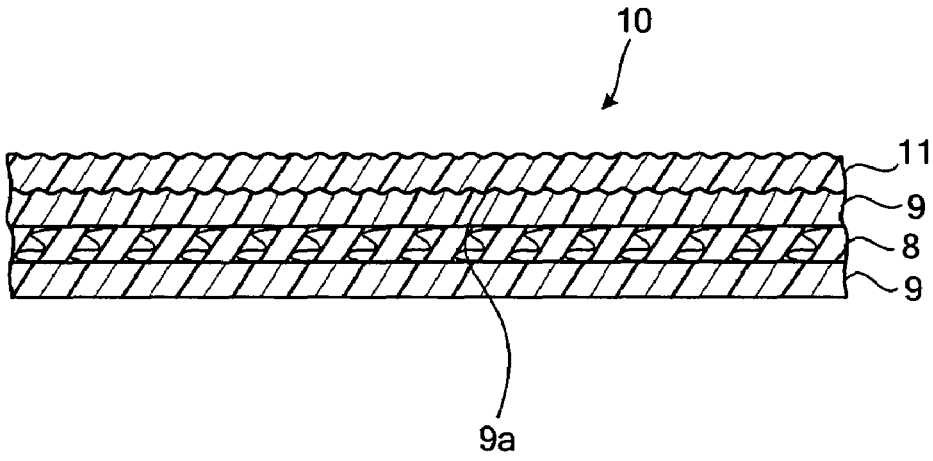
FIG. 9 is a schematic cross-sectional view showing another example of a sheet.
Figure 10:
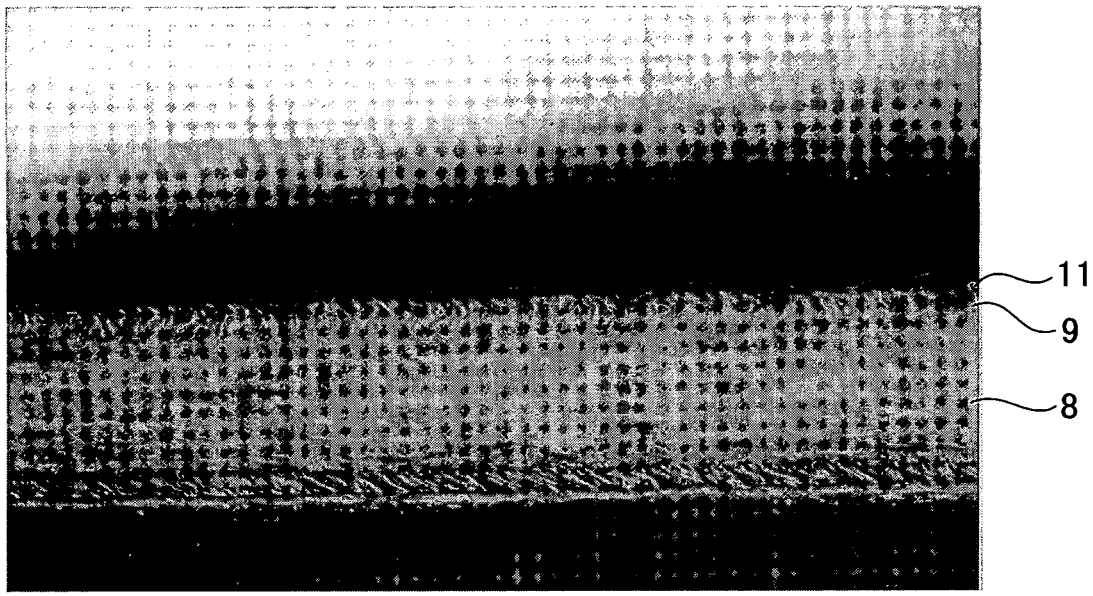
FIG. 10 is a cross-sectional photograph of a sheet after surface treatment.

As shown in FIG. 9, a sheet 10 may comprise thermoplastic resin layers 9 on both sides of a base 8, and an image forming layer 11 on one of the thermoplastic resin layers 9. According to the surface treatment of the present invention, in the sheet 10, the surface quality of the contact member can be transferred not only to the surface of the image forming layer 11, but also to the interface 9*a* of the thermoplastic resin layer 9 with the image forming layer 11 on the image forming layer side. This is observed in the cross-sectional photograph of FIG. 10 (magnification: 138 times), showing that in the cross-section of the sheet 10 after surface treatment, the image forming layer 11 is also deformed following the deformation of the thermoplastic resin layer 9. This shows also that the surface quality is transferred not only to the image forming layer 11 but also to the thermoplastic resin layer 9. In addition, it can be seen that the thickness of the image forming layer 11 is substantially uniform even after the surface treatment.

Base

Examples of the base include synthetic paper (synthetic paper made from, for example, polyolefins or polystyrenes), woodfree paper, art paper, (double-sided) coated paper, (double-sided) cast coat paper, mixed paper made from polyethylene or another synthetic resin pulp and natural pulp; Yankee paper, baryta paper, wallpaper, backing paper, synthetic resin- or emulsion-impregnated paper, synthetic rubber latex-impregnated paper, paper comprising a synthetic resin as an internal additive, paperboard, cellulosic fiber. paper, and other paper substrates; films and sheets of plastics or polymers such as polyolefins, poly(vinyl chloride), poly(ethylene terephthalate), poly(styrene methacrylate), poly(ethylene naphthalate), polycarbonate-poly(vinyl chloride), polystyrenes, polypropylenes, polyimides, celuloses such as triacetylcellulose; films and sheets obtained by subjecting these plastic films and sheets to a treatment, such as addition of a pigment such as titanium oxide for imparting white-reflecting properties; fabrics; metals, and glass.

Each of these bases can be used alone or in combination as a multilayer assemblage.

Examples of the base can also be found in JP-A No. 62-253159 (pp. 29–31 in Japanese), JP-A No. 01-61236 (pp. 14–17 in Japanese), JP-A No. 63-316848, JP-A No. 02-22651, JP-A No. 03-56955, and U.S. Pat. No. 5,001,033.

The thickness of the base is generally from 25 to 300 μm, preferably from 50 to 260 μm, and more preferably from 75 to 220 μm.

The stiffness (rigidity) of the base is not specifically limited, can be appropriately selected depending on an intended purpose and are preferably near to those in bases for use in color silver halide photography when the sheet is used as an image-receiving sheet of photographic quality.

The base may further comprise various additives appropriately selected according to the purpose within ranges not adversely affecting the advantages of the present invention.

Such additives include, but are not limited to, brightening agents (whitening agents), conductant agents, fillers, and pigments and dyes such as titanium dioxide, ultramarine blue, and carbon black.

The base may be subjected to any of surface treatments and/or primary coatings at one or both sides thereof to thereby improve adhesion with another layer such as a thermoplastic resin layer arranged thereon.

Such surface treatments include, for example, embossing or printing to form a glossy surface, a fine surface described in JP-A No. 55-26507, a matte surface or a tweed surface, corona discharge treatment, flame treatment, plasma treatment, and other activation treatments.

Each of these treatments can be employed alone or in any combination. For example, the base is subjected to the embossing and then to the activation treatment. It may be further subjected to the undercoating treatment after a surface treatment such as the activation treatment.

The base may be coated with a hydrophilic binder, a semiconductive metal oxide such as alumina sol or tin oxide, and an antistatic agent such as carbon black on its front side and/or back side. Typical disclosure of these coated bases can be found in, for example, substrates in JP-A No. 63-220246.

Thermoplastic Resin Layer

The thermoplastic resin forming the thermoplastic resin layer is not specifically limited, may be selected according to the purpose and includes, for example, polyolefins, poly(vinyl chloride)s, poly(ethylene terephthalate)s, polystyrenes, polymethacrylates, polycarbonates, polyimides, and triacetylcellulose, of which polyolefins are preferred. Each of these resins can be used alone or in combination.

Generally, a low-density polyethylene is used as the polyolefin. However, for improving the thermal resistance of the support, it is preferred to use a polypropylene, a blend of a polypropylene and a polyethylene, a high-density polyethylene, or a blend of the high-density polyethylene and a low-density polyethylene. From the viewpoint of cost and its suitableness for the lamination, it is preferred to use the blend of the high-density polyethylene and the low-density polyethylene.

The blend of the high-density polyethylene and the low-density polyethylene is used in a blend ratio (a mass ratio) of, for example, from 1:9 to 9:1, preferably from 2:8 to 8:2, and more preferably from 3:7 to 7:3. When the thermoplastic resin layer is applied to both sides of the support, the back side of the support is, for example, preferably the high-density polyethylene or a blend of the high-density polyethylene and the low-density polyethylene. The molecular weight of the polyethylenes is not particularly limited. Desirably, both of the high-density polyethylene and the low-density polyethylene have a melt index of 1.0 to 40 g/10-min and a high extrudability.

The sheet or film to be laminated may be subjected to a treatment to impart white reflection thereto. For example, a pigment such as titanium dioxide is incorporated into the sheet or film.

Image-Forming Layer

The image-forming layer, in the case of silver halide photography, corresponds to an emulsion layer which generates the colors YMC, and in the present invention means an emulsion layer prior to exposure and developing, or an emulsion layer after exposure and developing.

In the case of inkjet, it corresponds to an inkjet image-receiving layer which receives ink, and in the present invention means an ink receiving layer prior to adhesion of ink or an ink receiving layer after adhesion of ink.

In the case of electrophotography, it corresponds to a toner image-receiving layer, and in the present invention means a toner image-receiving layer prior to adhesion of toner or a toner image-receiving layer after adhesion of toner.

The image-forming layer and thermoplastic resin layer may be identical.

Other Units

The other units are not particularly limited and may be suitably selected according to the purpose, for example a positioning unit, a preheating unit, a sheet pressure unit or a control unit, etc.

The positioning unit performs the positioning of the sheet and the contact member. If this positioning unit is provided, surface treatment can be performed without any positional offset on the sheet surface to be treated, and as it offers excellent surface treatment efficiency and reliability, it is very advantageous.

The specific examples of the positioning unit are not particularly limited and may be suitably selected according to the purpose, but a sensor or the like is convenient. This sensor is not particularly limited, and may be a sensor which detects reflected light or reflected sound.

The preheating unit is a unit which preheats the sheet before it is heated by the sheet heating unit.

If this preheating unit is provided, the required heat amount when the sheet is heated by the sheet heating unit will be less, and different parts of the sheet treatment surface can be brought to the softening state or melting state without any risk of the heat being insufficient, which is an advantage. Also, as the preheating unit has a small thermal capacity and can heat the sheet while it is being transported, it is effective when a thermal head having a necessarily short heating time is used.

The specific examples of the preheating unit are not particularly limited and may be suitably selected according to the purpose, i.e., a heat roller, heater or a heating part of the image-forming apparatus (e.g., the drying part of a silver halide photography minilab, or the fixing part of an electrophotographic apparatus). In this case, the aforesaid heating part and surface treatment part must be brought sufficiently close together so that the temperature of the printed paper which has been heated in the drying part, does not fall too much.

The sheet pressure unit is a unit which brings the sheet and contact member into pressure contact.

If this sheet pressure unit is provided, when the sheet is heated by the sheet heating unit, the surface qualities of the contact member can be transferred even if the sheet is not brought into contact with the contact member, it is very advantageous.

The specific examples of the sheet pressure unit are not particularly limited and may be suitably selected according to the purpose, e.g. a pressure roller or the like.

The control unit may have the function of selecting a heating pattern according to the type of sheet, customer specifications and shop information, or controlling the operation of the sheet heating unit and controlling surface treatment conditions, and may have the further function of controlling the superimposition position of the sheet and contact member based on information supplied by the positioning unit.

The type of sheet is not particularly limited, but it is preferably comprises at least a thermoplastic resin layer. It may for example be suitably selected from among the sheets (media) used in the image-forming methods known in the art, specific examples being a thermosensitive recording sheet, an inkjet sheet, an electrophotographic sheet, a hot developing sheet, a silver halide photography sheet and a silver halide digital photography sheet or the like, but a sheet having the aforesaid thermoplastic resin layer on the surface is particularly preferred.

The treatment conditions are not particularly limited and may be suitably selected according to the purpose, for example the heating temperature in the sheet heating unit, pressure force, heating time and pressure time, cooling temperature in the sheet cooling unit and cooling time, but more specifically the temperature of the heat roller disposed on the inside of the endless belt or the temperature of the heat roller in contact with the endless belt which forms a nip part in the pair of heat rollers, the pressure of this nip part, the air blow amount of a cooling fan in the cooling apparatus, the distance between the pair of heat rollers and the aforesaid rotating rollers, and the rotation speed of the endless belt (transport speed of the sheet).

The design may be such that a heating pattern can be selected for example via a screen. As for the heating pattern, the design is preferably such that, in the case of for example a gloss impression after treatment, it is possible to select at least one of a gloss, embossed and matt finish in all or part of the surface, but more preferred that it is possible to select at least one of a gloss and matt finish in all or part of the surface.

The surface treatment apparatus of the present invention may be used alone, or may be built into or connected to an image-forming apparatus known in the art.

The surface treatment apparatus of the present invention is particularly suitable for the image-forming apparatus of the present invention described below.

(Image-Forming Apparatus)

The image-forming apparatus of the present invention comprises an image-forming device, a surface treatment unit, and other units selected as necessary.

Image-Forming Device

The image-forming device is not particularly limited provided that it can form an image on the sheet, and may be suitably selected from image-forming apparatuses known in the art which form images by image-forming methods known in the art such as for example inkjet recording, thermosensitive recording, silver halide photography, heat developing/recording or electrophotography.

Surface Treatment Unit

The surface treatment unit is not particularly limited provided that it can perform surface treatment of the sheet on which the image is formed by the aforesaid image-forming device, and may be selected as appropriate, but the surface treatment apparatus of the present invention described above is particularly suitable.

In the image-forming apparatus, the surface treatment unit may be built into the image-forming device, or it may be provided externally to the image-forming device.

Other Units

There is no particular limitation on the other units which may be suitably selected according to the purpose, for example, a control unit or the like.

There is no particular limitation on the aforesaid control unit which may be any of those used in image-forming apparatuses known in the art, but it preferably can drive or stop driving the surface treatment unit so as to perform or not perform surface treatment of the sheet. The control unit is not provided independently, and a treatment control unit in the surface treatment apparatus may also provide the functions of this control unit.

If the control unit is provided, when the control unit stops driving the surface treatment unit, the image formed by the image-forming device can be ejected from the image-forming apparatus without passing through the surface treatment unit (bypass route), and when it drives the surface treatment unit, the image formed by the image-forming device can be ejected from the image-forming apparatus after passing through the surface treatment unit to perform surface treatment.

According to the image-forming apparatus of the present invention, all or part of the surface of the image obtained may have any desired quality such as gloss, matt or embossed, for example plural surface glosses can be obtained even for the same image.

The present invention will now be described referring to specific examples, but it should be understood that the invention is not limited in any way thereby.

EXAMPLE 1

The image-forming apparatus of Example 1 comprises an image-forming device (not shown in the diagram) and a surface treatment unit.

The image-forming device in this example is a silver halide digital color photography apparatus. The silver halide digital color photography apparatus used was an apparatus known in the art.

The surface treatment unit used was the surface treatment apparatus of the present invention. In this design, the surface treatment apparatus is connected to an eject tray of the image-forming device. When the surface treatment apparatus is driven, sheets (New Year card size digital color photographs) ejected by the discharge tray are taken into the apparatus so that a predetermined surface treatment can be performed.

As shown in FIG. 1A, the surface treatment apparatus in this example comprises a sheet heating unit 1 and a sheet cooling unit 6.

The sheet heating unit 1 comprises a pair of heat rollers 2*a*, 2*b* and an endless belt 3-1 which functions as a contact member.

The heat rollers 2*a*, 2*b* comprise built-in heaters, and are designed so that the temperature can be freely adjusted. The heat roller 2*b* is disposed so that it can rotate on the inner side of the endless belt 3-1 while in contact with the inner surface of the endless belt 3-1. The heat roller 2*a* is disposed on the outer side of the endless belt 3-1, and comes in contact with the outer surface of the endless belt 3-1 so that it can rotate in pressure contact with the heat roller 2*b*.

Figure 1B:
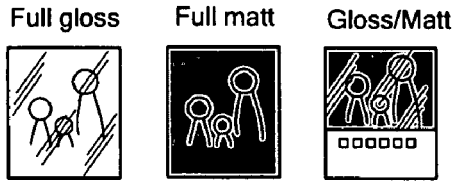
FIG. 1B is a schematic diagram showing examples of the sheets with the resulted photographic images.
Figure 1C:
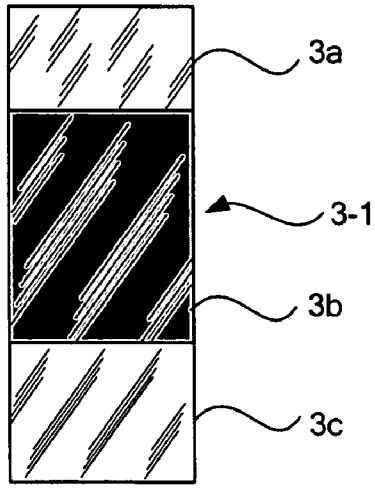
FIG. 1C is a schematic diagram showing an example of the endless belt.

As shown in FIG. 1C, in the endless belt 3-1, plural contact member corresponding parts having a size corresponding to the size of the sheet (New Year card size digital color photograph) 10 are connected to form the endless belt. The contact member corresponding parts comprise a part 3*a* whereof the whole surface is a gloss surface, a part 3*b* whereof the whole surface is a matt surface, and a part 3*c* whereof part is a gloss surface and part is a matt surface.

As shown in FIG. 1A, the endless belt 3-1 is suspended between the heat roller 2*b*, and a rotation roller 4 and suspension roller 5 disposed inside the endless belt 3-1.

According to this example, the sheet cooling unit 6 is a cooling apparatus fitted with an air blower, is installed inside the endless belt 3-1, and is disposed between the heat roller 2*b* and rotation roller 4.

When this surface treatment apparatus is driven, first, the sheet (New Year card size digital color photograph) 10 to be treated is transported from the eject tray in the image-forming apparatus to the interior of the surface treatment apparatus, and is conveyed along the transport direction A. The transport up to this point is performed by a transport roller or transport belt, and in Example 1, the design is such that this is performed by a transport belt. The control unit then adjusts the rotation speed of the endless belt 3-1 and the transport speed of the sheet (New Year card size digital color photograph) 10 based on a positioning sensor disposed slightly upstream of the nip part formed by the pair of heat rollers 2*a*, 2*b* and a positioning sensor disposed in the vicinity of the surface of the endless belt 3-1 and in the vicinity of the surface of the heat roller 2*b*, and performs positioning so that there is no positional offset between the contact member corresponding parts of the endless belt 3-1 and the sheet (New Year card size digital color photograph) 10. Next, the sheet (New Year card size digital color photograph) 10 enters the nip part formed between the pair of heat rollers 2*a*, 2*b*. The sheet (New Year card size digital color photograph) 10 inserted into the nip part rotates together with the pair of heat rollers 2*a*, 2*b* and is brought into contact with the surface of the endless belt 3-1. The rotation roller 4 and suspension roller 5 may rotate in synchronism with the rotation of the endless belt 3-1, or may be designed so that they are rotation driven to rotate the endless belt 3-1 together with the pair of heat rollers 2*a*, 2*b*. According to this example, the ration roller 4 and suspension roller 5 have the former design.

At this time, as shown in FIG. 9, the heat rollers 2*a*, 2*b* are heated to a temperature at which the thermoplastic resin layer (in Example 1, this corresponds to the polyethylene resin layer coating the surface of the New Year card size digital color photograph) of the sheet 10 can soften, so the sheet 10 inserted in the nip part is heated to a temperature at which the thermoplastic resin layer in the nip part softens and can deform. The thermoplastic resin layer in the nip part therefore softens, and becomes able to deform. At this time, pressure is applied to the nip part by the pressure force of the heat roller 2*a*, so when the sheet 10 passes through the nip part while superimposed on a predetermined position of the endless belt 3-1 under pressure, the thermoplastic resin layer which is in its softest state in the sheet 10 deforms while being pressed by the pair of heat roller 2*a*, 2*b*, and the surface qualities of the endless belt 3-1 are transferred to the surface of the sheet 10. The sheet 10 then passes through the nip part while in intimate contact with the surface of the endless belt 3-1, and is transported along the transport direction A (FIG. 1A).

Next, the sheet 10 is cooled by the cooling apparatus 6 while in intimate contact with the surface of the endless belt 3-1, and the thermoplastic resin layer thereon solidifies. It is thereby transported up to the rotation roller 4. At the rotation roller 4, as transport direction A of the endless belt 3-1 changes by 90° or more, the sheet 10 is separated from the surface of the endless belt 3-1 whereof the transport direction has abruptly changed. The sheet 10 which is separated from the surface of the endless belt 3-1 is then stored in a tray 12.

The surface qualities of the endless belt 3-1 are thereby transferred to the surface of the sheet 10 thus obtained. As shown in FIG. 1B, if a photographic image is formed on the whole surface, the whole surface is glossy like a mirror or matt, and if a character information surface or white background surface is present in one part, only the location where the photographic image is formed has a mirror-like glossy surface, and the character information surface or white background surface is a matt surface. The matt surface is easy to write upon.

EXAMPLE 2

Figure 2A:
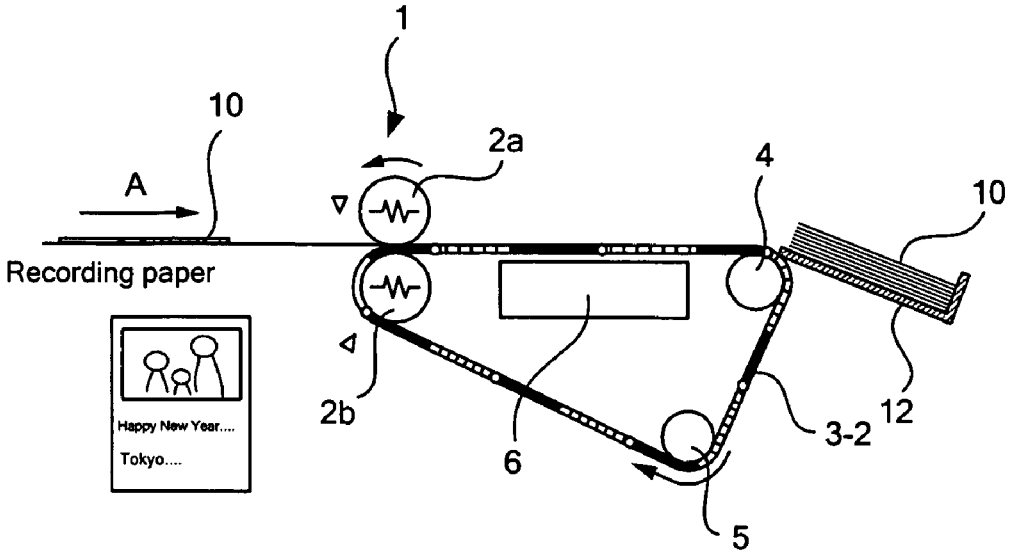
FIG. 2A is a schematic diagram showing an example of a surface treatment apparatus according to the present invention.

The surface treatment unit in Example 1 is replaced by the surface treatment unit shown in FIG. 2A. This is identical to the surface treatment unit in Example 1, expect that in this surface treatment unit, the sheet (New Year card size digital color photograph) 10 to be surface-treated is replaced by the sheet (New Year card having a digital color photographic image is one part, with character information printed underneath the photographic image) 10, and the endless belt 3-1 is replaced by the endless belt 3-2 wherein glossy surfaces 3*c* are disposed at a predetermined interval in a matt surface 3*d*. The glossy surfaces 3*c* of the endless belt 3-2 are positioned and superimposed on the photographic image part of the sheet (New Year card having a digital color photographic image in one part, with character information printed underneath the photographic image) 10.

Figure 2B:
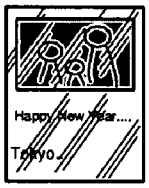
FIG. 2B is a schematic diagram showing examples of the sheets with the resulted photographic images.
Figure 2C:
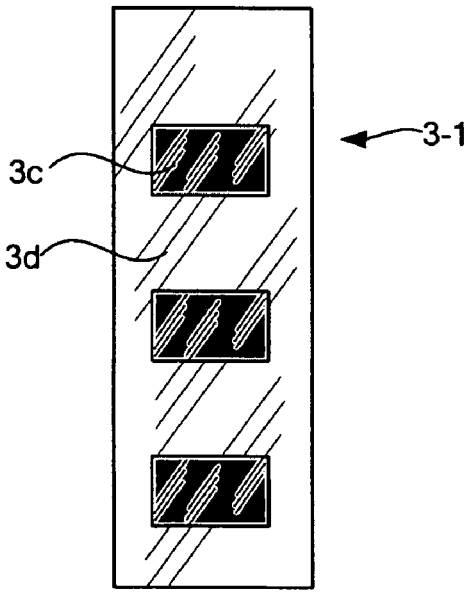
FIG. 2C is a schematic diagram showing an example of the endless belt.

The surface qualities of the endless belt 3-2 are transferred to the surface of the sheet 10 obtained by surface treatment as in the case of Example 1. As shown in FIG. 2B, the photographic image part of the sheet (New Year card having a digital color photographic image in one part, with character information printed underneath the photographic image) 10 is a gloss surface, and the other part is a matt surface. The part with the matt surface is easy to write upon.

EXAMPLE 3

Figure 3:
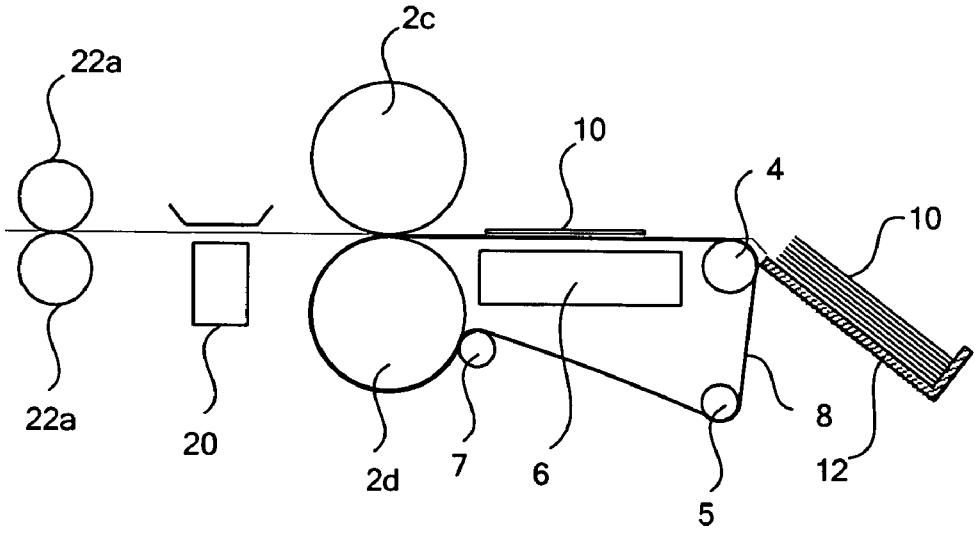
FIG. 3 is a schematic diagram showing an example of the surface treatment apparatus of the present invention provided with a preheating unite.
Figure 7:
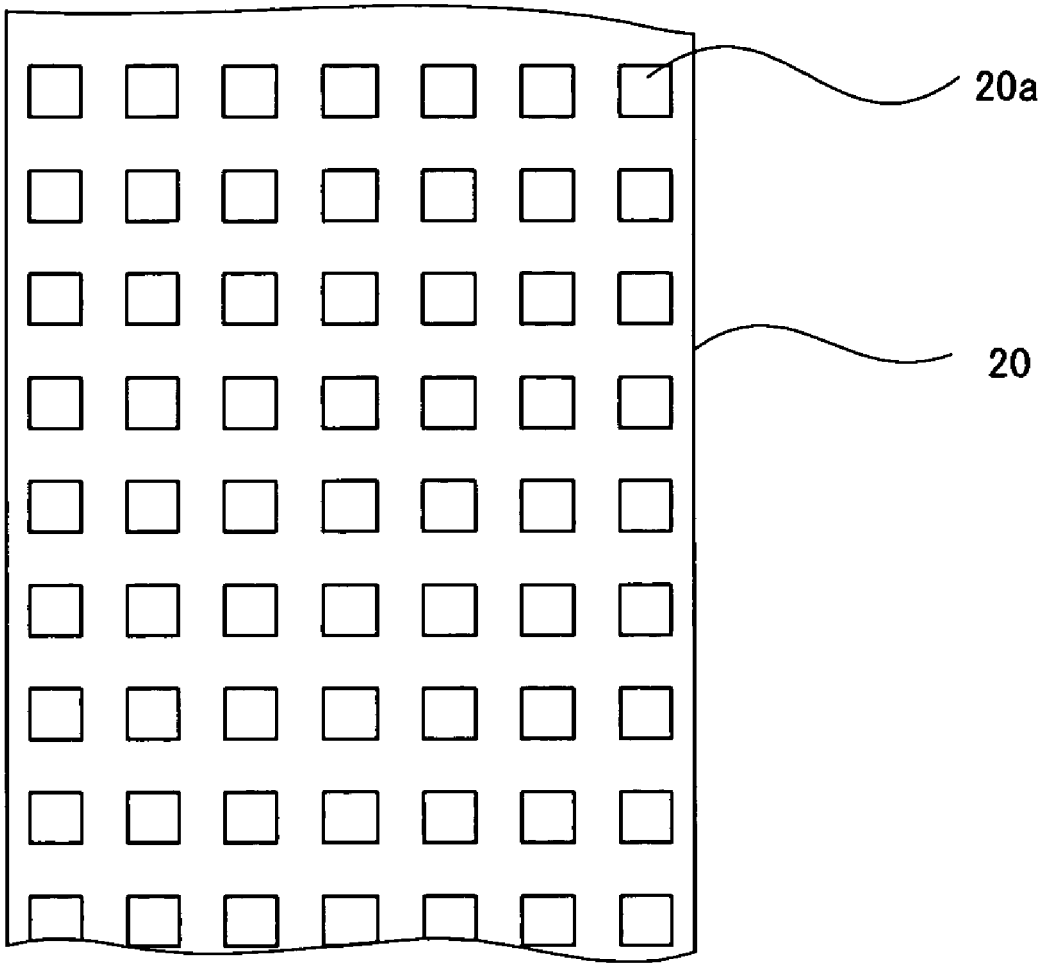
FIG. 7 is a diagram showing an example of a thermal head.
Figure 8:
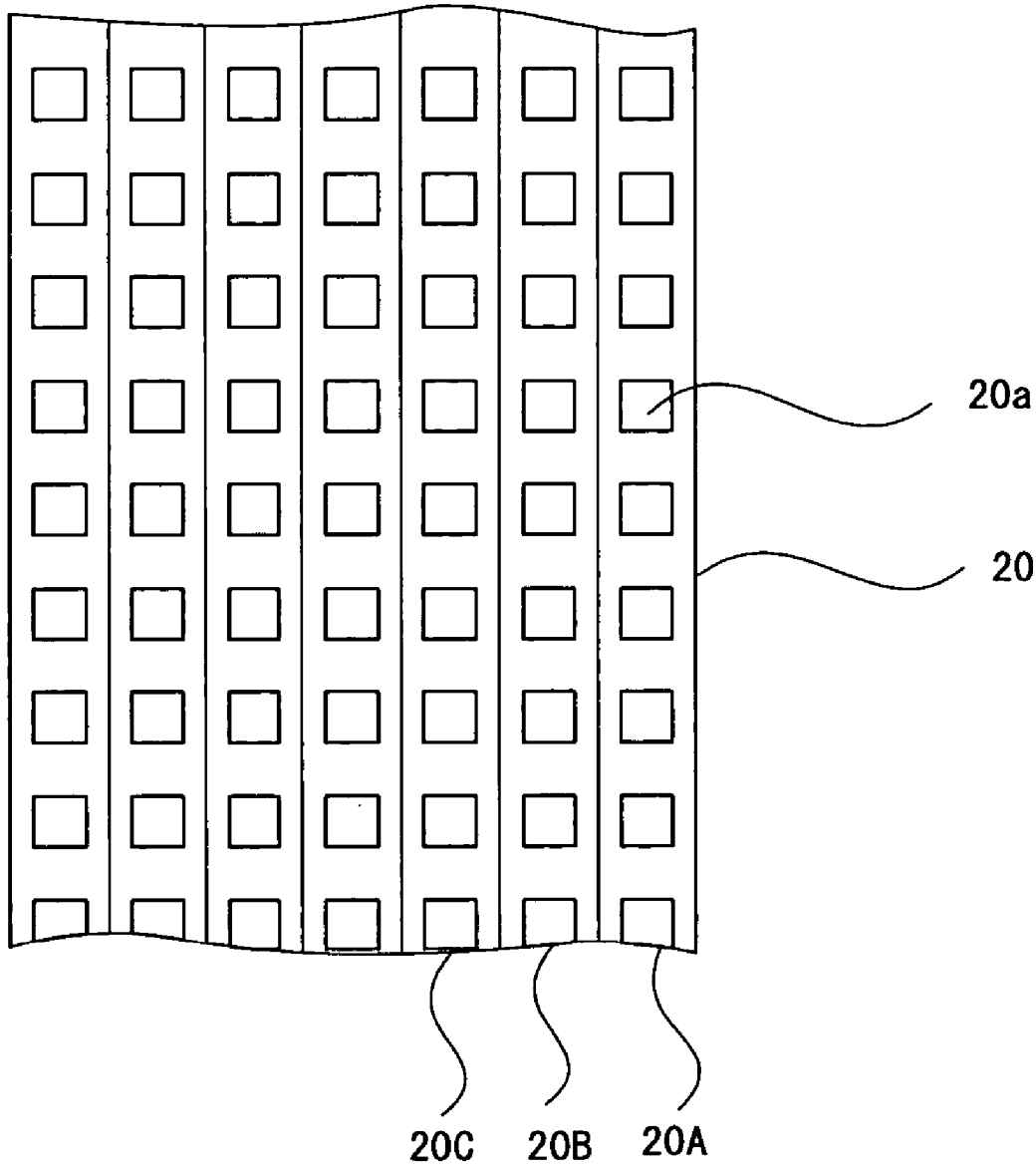
FIG. 8 is a diagram showing another example of a thermal head.

This is identical to Example 1, expect that in the surface treatment unit of Example 1, as shown in FIG. 3, the pair of heat rollers 2*a*, 2*b* are replaced by a pair of heat rollers 2*c*, 2*d* without using the endless belt which functions as the contact member, a thermal head 20 which can imagewise heat the image is disposed upstream of the pair of heat rollers 2*c*, 2*d* in the transport direction, and a preheating roller 22*a* comprising a pair of heat rollers is disposed upstream in the transport direction. A rotation roller 7 is further provided in the vicinity of the heat roller 2*d* and in contact with the outer side of an endless belt 8 such that it can rotate. In Example 3, as shown in FIG. 7, in the thermal head 20, heating elements 20*a* are regularly arranged in rows vertically and horizontally, but as shown in FIG. 8, plural lines of the heating elements 20*a* arranged in rows may also be used.

The heating elements 20*a* in the thermal head 20 are designed so that, when a heating element driver which drives the individual heating elements 20*a* based on stored information in a storage unit which prestores image information for performing imagewise heating, drives the heating elements 20*a*, only heads in predetermined locations where the image can be formed generate heat. As a result, the sheet 10 is imagewise heated by the thermal head 20 according to predetermined image information.

In Example 3, as the sheet 10 is heated by the thermal head 20, the thermal capacity is small and the heating time is short, so the preheating roller 22*a* is provided to prevent thermal insufficiency. As the sheet 10 can be sufficiently heated by the preheating roller 22*a*, the thermoplastic resin layer in the sheet 10 heated by the thermal head 20 easily softens and melts due to the heat of the thermal head 20. Due to the thermal head 20, only the photographic image part of the sheet (New Year card having a digital color photographic image in one part, with character information printed underneath the photographic image) 10 is heated (imagewise heating). Hence, in the treated surface of the sheet 10 which is imagewise heated, only the heated part becomes glossy. As a result, the photographic image part of the sheet 10 has a glossy surface, and the other part remains a matt surface. The matt surface part is easy to write upon.

In Example 3, only the photographic image part was heated by the thermal head 20, but only the parts other than the photographic image, i.e. the non-photographic image parts, may be heated instead.

EXAMPLE 4

Figure 4:
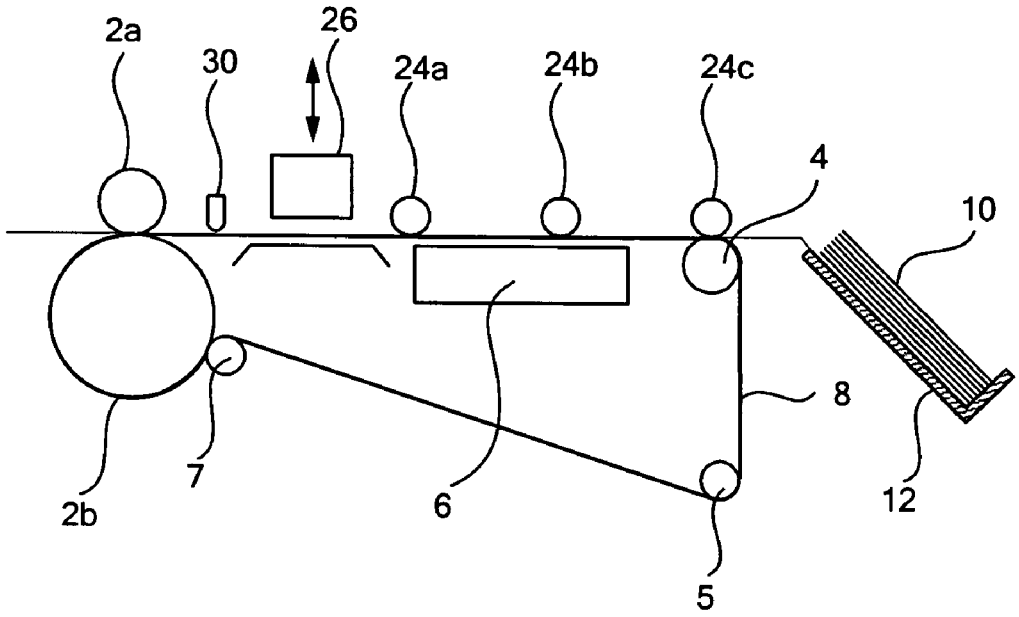
FIG. 4 is a schematic diagram showing another example of the surface treatment apparatus of the present invention provided with a preheating unit.

This is identical to Example 3, expect that in the surface treatment unit of Example 3, as shown in FIG. 4, the thermal head 20 is replaced by the heat and pressure heater 26 without using the preheating roller 22*a*, the heat and pressure heater 26 being disposed between the pressure roller 2*d* and sheet cooling unit 6 on the outer side of the endless belt 8, a positioning sensor 30 is provided between the heat and pressure heater 26 and pressure roller 2*c*, and rotation rollers 24*a*, 24*b*, 24*c* are provided between the thermal head 20 and rotation roller 4 on the outer side of the endless belt 8.

The heat and pressure heater 26 can heat the sheet 10 while applying pressure thereto. The surface of the heat and pressure heater 26 has a design or pattern which it is finally desired to obtain on the treated surface of the sheet 10. This design or pattern is formed with at least one of a glossy surface and a matt surface on the sheet. For this purpose, it is pressed by the heat and pressure heater 26, and the design or pattern formed with one of a glossy surface and matt surface is transferred to the treatment surface of the heated sheet 10.

In Example 4, heat and pressure are applied to the sheet 10 by the heat and pressure heater 26, the surface qualities of the heat and pressure heater 26 are transferred to its surface, the photographic image part of the sheet (New Year card having a digital color photographic image in one part, with character information printed underneath the photographic image) 10 becomes a glossy surface, and the other parts become a matt surface. The matt surface parts are easy to write upon.

EXAMPLE 5

Figure 5:
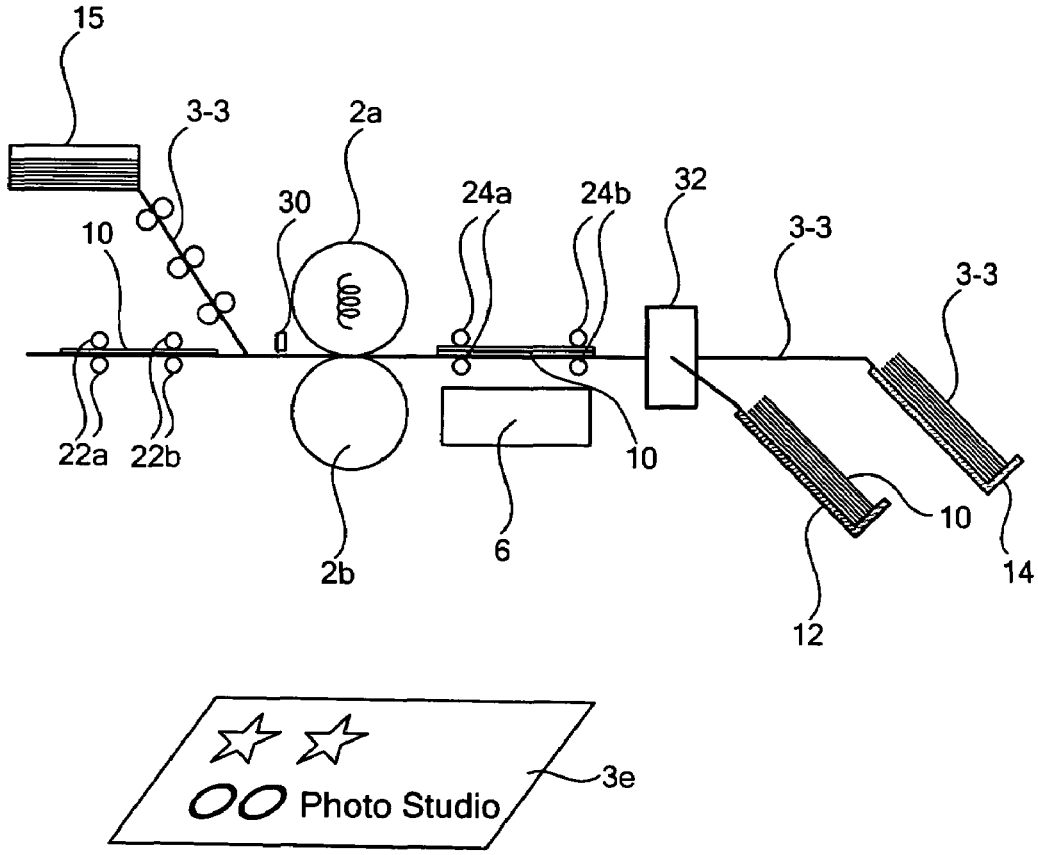
FIG. 5 is a schematic diagram showing an example of the surface treatment apparatus using a contact member which is a continuous sheet.

This is identical to Example 1, expect that as shown in FIG. 5, in the surface treatment unit of Example 1, the contact member 3-3 housed in a receptacle 15 is used superimposed on the undersurface of the sheet 10 without using the endless belt, and the contact member 3-3 is released from the sheet 10 by a releasing member 32 after cooling treatment by the sheet cooling unit 6.

The contact member 3-3 used in Example 5 is designed such that plural contact members respectively corresponding to each of the sheets 10 are joined together, and the sheets 10 can continuously be brought into contact one sheet at a time.

As shown in FIG. 5, a predetermined design is formed on the contact member 3-3, this design part being formed of a heat conducting material, and the non-designed parts outside this design part are formed of a non-heat conducting material. Consequently, even if heat is applied to one surface of the contact member 3-3, only the design part formed from a heat conducting material transmits heat to the other surface. In other words, the sheet 10 in contact with the contact member 3-3 is heated to resemble the design formed on the contact member 3-3. As a result, in the sheet 10 obtained, the design is transferred to this treatment surface, this design part has a glossy surface, and the non-design part has a matt surface.

In Example 5, in the contact member 3-3, the design part is formed of a heat conducting material, and the non-design part is formed of a non-heat conducting material, but the design part may be formed of a non-conducting material and the non-design part formed from a heat conducting material. Also, the design part may be formed as a matt surface and the non-design part formed as a glossy surface, or alternatively, the design part may be formed as a glossy surface and the non-design part formed as a mat surface.

In Example 5, the surface qualities of the contact member 3-3 are transferred to the undersurface of the sheet 10 obtained by surface treatment, so that shop information or the like (3*e*) can be displayed.

Figure 6:
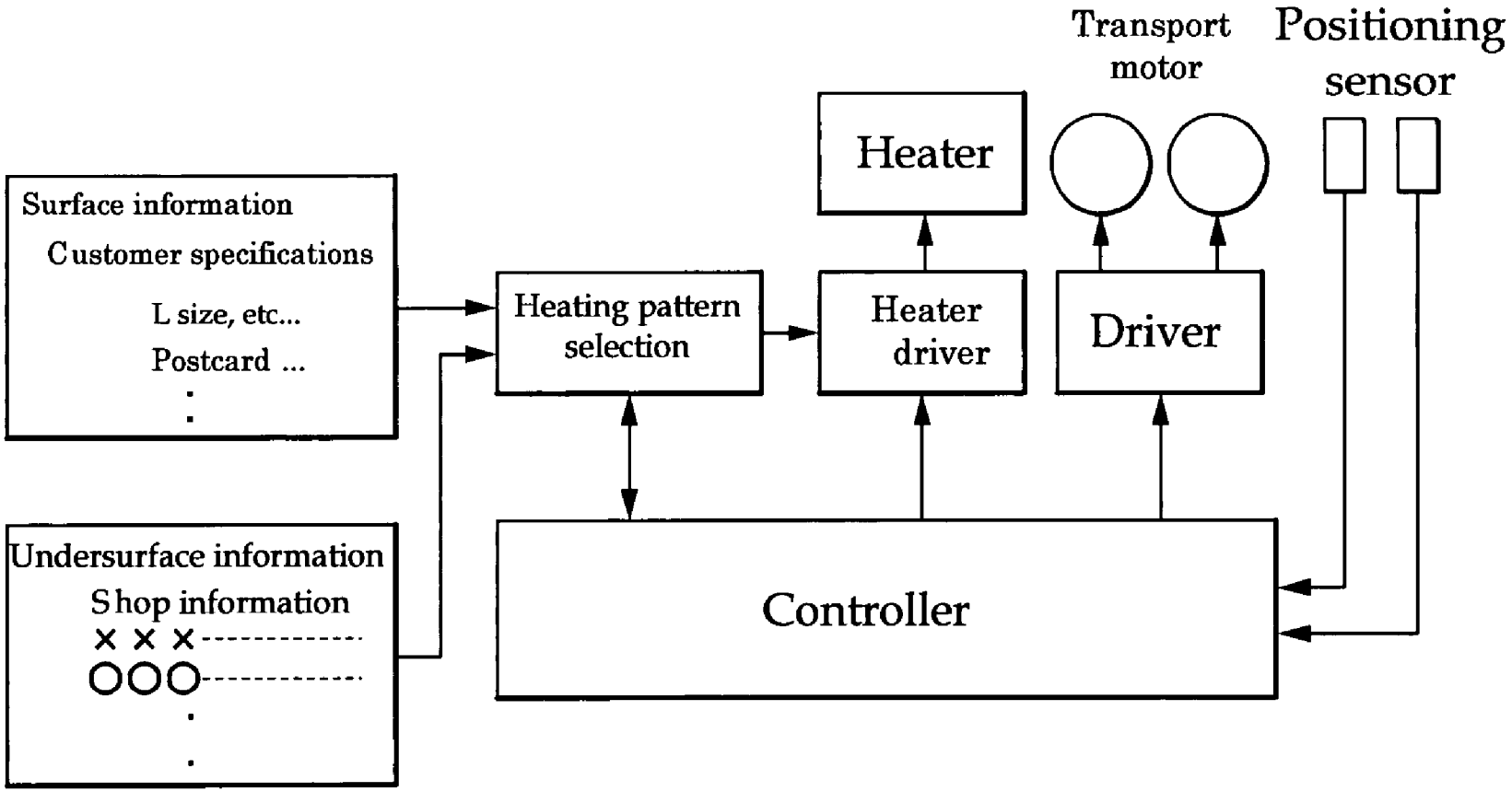
FIG. 6 is a schematic diagram showing an example of the control of a control unit in the surface treatment apparatus of the present invention.

In Examples 1 to 5, the control of treatment conditions may for example be performed as shown in FIG. 6. Specifically, a heating pattern is selected based on customer information (e.g., L size, postcard, etc.) for performing surface treatment and shop information for undersurface treatment. The control unit controls the driving of the heater in the sheet heating unit based on the selected heating pattern. Alternatively, the control unit controls the rotation speed of the rotation roller and endless belt based on detection information from the positioning sensor (position determining sensor). As a result, surface treatment can be efficiently performed without positional offset.

What is claimed is:

1. A surface treatment apparatus comprising:

a sheet heating unit which heats a sheet;

a sheet cooling unit which cools the sheet while in contact with a contact member; and a depression-and-protrusion shape control unit which forms depression-and-protrusion shapes by differently treating different parts of the surface of the sheet by at least one of the sheet heating unit and the sheet cooling unit.

2. A surface treatment apparatus according to claim 1, wherein the sheet heating unit heats the sheet in contact with the contact member.

3. A surface treatment apparatus according to claim 1, wherein the sheet comprises at least a thermoplastic resin layer formed with a thermoplastic resin, wherein the thermoplastic resin in the thermoplastic resin layer is a polyolefin resin.

4. A surface treatment apparatus according to claim 3, wherein the sheet heating unit heats the sheet to a temperature equal to or higher than the softening point of the thermoplastic resin in the thermoplastic resin layer.

5. A surface treatment apparatus according to claim 3, wherein the sheet cooling unit cools the sheet to a temperature less than the softening point of the thermoplastic resin in the thermoplastic resin layer.

6. A surface treatment apparatus according to claim 1, wherein the sheet comprises a base, and a thermoplastic resin layer and an image-forming layer above the base, and the depression-and-protrusion shape control unit forms depression-and-protrusion shapes on the image-forming layer surface and the interface of the thermoplastic resin layer on the image-forming layer side.

7. A surface treatment apparatus according to claim 1, wherein the contact member has different qualities in at least one part.

8. A surface treatment apparatus according to claim 7, wherein the qualities are at least one of surface qualities and heat conducting properties.

9. A surface treatment apparatus according to claim 1, wherein the contact member is an endless belt.

10. A surface treatment apparatus according to claim 9, wherein the sheet heating unit comprises the endless belt, and a pair of heat rollers disposed in pressure contact from the inner side and outer side of the endless belt.

11. A surface treatment apparatus according to claim 1, wherein the sheet heating unit supplies a different heat amount in at least one part of the sheet.

12. A surface treatment apparatus according to claim 11, wherein the sheet heating unit comprises a thermal head.

13. A surface treatment apparatus according to claim 12, wherein the thermal head comprises plural heating elements disposed vertically and horizontally within a predetermined area.

14. A surface treatment apparatus according to claim 1, further comprising:

a positioning unit which performs positioning of the sheet and the contact member.

15. A surface treatment apparatus according to claim 1, wherein the sheet is selected from a thermosensitive recording sheet, an inkjet sheet, an electrophotographic sheet, a hot developing sheet, a silver halide photography sheet, and a silver halide digital photography sheet.

16. A surface treatment apparatus according to claim 1, further comprising:

a preheating unit which preheats the sheet prior to heating by the sheet heating unit.

17. An image-forming apparatus comprising:

an image-forming device which forms an image on a sheet; and a surface treatment unit which performs surface treatment of the sheet on which the image is formed, wherein the image-forming device comprising:

a sheet heating unit which heats the sheet;

a sheet cooling unit which cools the sheet in contact with a contact member; and a depression-and-protrusion shape control unit which forms depression-and-protrusion shapes by differently treating different parts of the surface of the sheet by at least one of the sheet heating unit and the sheet cooling unit.

18. An image-forming apparatus according to claim 17, wherein the sheet comprises a thermoplastic resin layer formed with a thermoplastic resin, wherein the thermoplastic resin in the thermoplastic resin layer is a polyolefin resin.

19. An image-forming apparatus according to claim 18, wherein the sheet heating unit heats to a temperature equal to or higher than the softening point of the thermoplastic resin in the thermoplastic resin layer.

20. An image-forming apparatus according to claim 18, wherein the sheet cooling unit cools to a temperature less than the softening point of the thermoplastic resin in the thermoplastic resin layer.

21. An image-forming apparatus according to claim 17, wherein the sheet comprises a base, and a thermoplastic resin layer and an image-forming layer on the base, and the depression-and-protrusion shape control unit forms depression-and-protrusion shapes on the image-forming layer surface and the interface of the thermoplastic resin layer on the image-forming layer side.

22. An image-forming apparatus according to claim 17, wherein the contact member has different qualities in at least one part.

23. An image-forming apparatus according to claim 22, wherein the qualities are at least one of surface qualities and heat conducting properties.

24. An image-forming apparatus according to claim 17, wherein the contact member is an endless belt.

25. An image-forming apparatus according to claim 24, wherein the sheet heating unit comprises the endless belt, and a pair of heat rollers disposed in pressure contact from the inner side and outer side of the endless belt.

26. An image-forming apparatus according to claim 17, wherein the sheet heating unit supplies a different heat amount in at least one part of the sheet.

27. An image-forming apparatus according to claim 26, wherein the sheet heating unit comprises a thermal head.

28. An image-forming apparatus according to claim 27, wherein the thermal head comprises plural heating elements disposed vertically and horizontally within a predetermined area.

29. An image-forming apparatus according to claim 17, further comprising:

a positioning unit which performs positioning of the sheet and the contact member.

30. An image-forming apparatus according to claim 17, further comprising:

a preheating unit which preheats the sheet prior to heating by the sheet heating unit.

* * * * *